United States Patent [19]

Takamizawa et al.

[11] Patent Number: 4,572,593

[45] Date of Patent: Feb. 25, 1986

[54] DISPLAY CASE

[76] Inventors: Daisuke Takamizawa, 29-14, Wakabayashi 3-Chome, Setagaya-ku, Tokyo; Aguri Okada, No. 75, Kuramatsu, Sugitomachi, Kitakatsushika-gun, Saitama-ken; Hisayoshi Ito, 13-25, Shimizugaoka 3-Chome, Fuchu-shi, Tokyo, all of Japan

[21] Appl. No.: 619,822

[22] Filed: Jun. 12, 1984

[51] Int. Cl.[4] ..... A47F 7/00

[52] U.S. Cl. ..... 312/114; 312/258

[58] Field of Search ..... 312/257 A, 257 SK, 257 SM, 312/257 R, 114, 140, 258

[56] References Cited

U.S. PATENT DOCUMENTS

| | | | |
|---|---|---|---|
| 2,475,079 | 7/1949 | Clouse et al. | 312/140 |
| 2,580,029 | 12/1951 | Krauss | 312/140 |
| 3,494,686 | 2/1970 | Diak | 312/257 R |
| 3,556,622 | 9/1968 | Rubin et al. | 312/257 X |

FOREIGN PATENT DOCUMENTS

| | | | |
|---|---|---|---|
| 2132153 | 1/1972 | Fed. Rep. of Germany . | |
| 625285 | 3/1926 | France | 312/140 |

*Primary Examiner*—William E. Lyddane
*Assistant Examiner*—Joseph Falk
*Attorney, Agent, or Firm*—Watson, Cole, Grindle & Watson

[57] ABSTRACT

Disclosed is a display case comprising a gate-shaped front frame and a gate-shaped rear frame, both ends of each frame being separably mounted on four corners of a bed frame. The display case also includes a left and a right square side frame, the lower portions of both side frames being mounted by hinges interiorly of both left and right sides of the bed frame. Both left and right side frames are able to be laid down and housed within the bed frame and are able to be erected internally of the front frame and the rear frame, both of the erected left and right side frames being separably secured to the front frame and the rear frame. Transparent sliding doors are provided in the front frame and the rear frame and transparent glass plates are provided in both left and right square frames and on the upper surface of the display case.

4 Claims, 8 Drawing Figures

DISPLAY CASE

Figure 1:
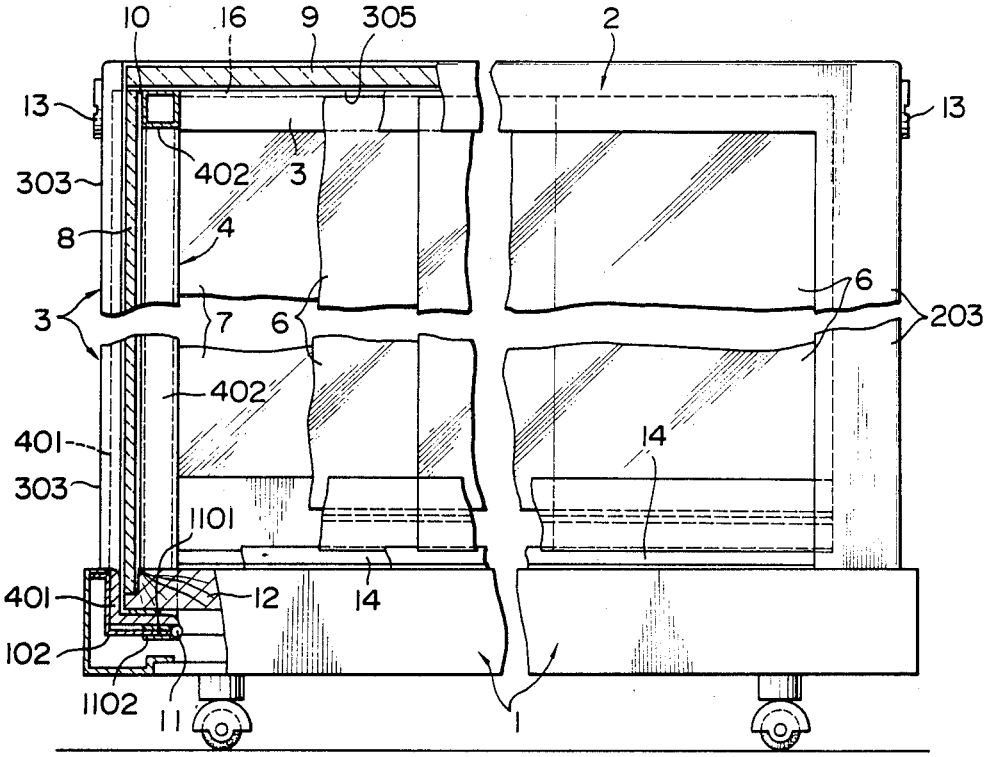

The present invention relates generally to a display case, also commonly termed a glass case, a show case or the like, and more particularly, to a collapsible display case in which sliding doors are provided on both a front surface and a rear surface thereof.

A display case designed such that sliding doors are provided on a front surface and a rear surface thereof is known. A further known display case is designed so that front, rear, left and right frames are each separably provided on a bed frame.

In accordance with these known techniques, in the former display case, the front, rear, left and right frames tend to move with respect to the bed frame resulting in an unstable condition, and in the latter display case, a sliding door cannot be provided on the front frame.

The present invention has been achieved in view of these inconveniences noted above with respect to the prior art display cases. It is therefore an object of the present invention to provide a useful display case in which sliding doors are provided on a front surface and on a rear surface, both left and right frames can be laid down with respect to a bed frame, and even if the front and rear frames are separable with respect to the bed frame, the front, rear, left and right frames have less tendency to move with respect to the bed frame and thus the display case is quite stable.

An embodiment of the invention will now be described with reference to the accompanying drawings.

Figure 2:
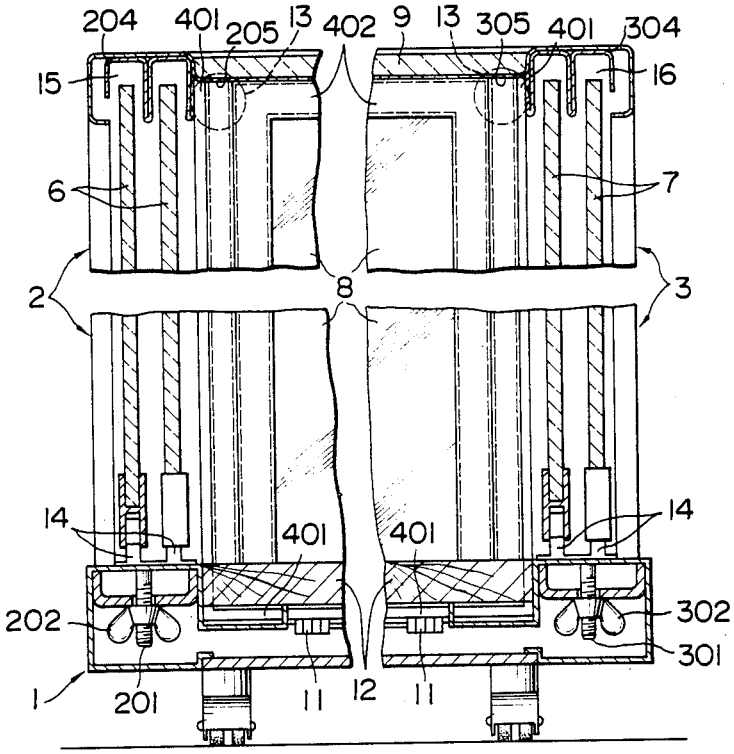
Figure 3:
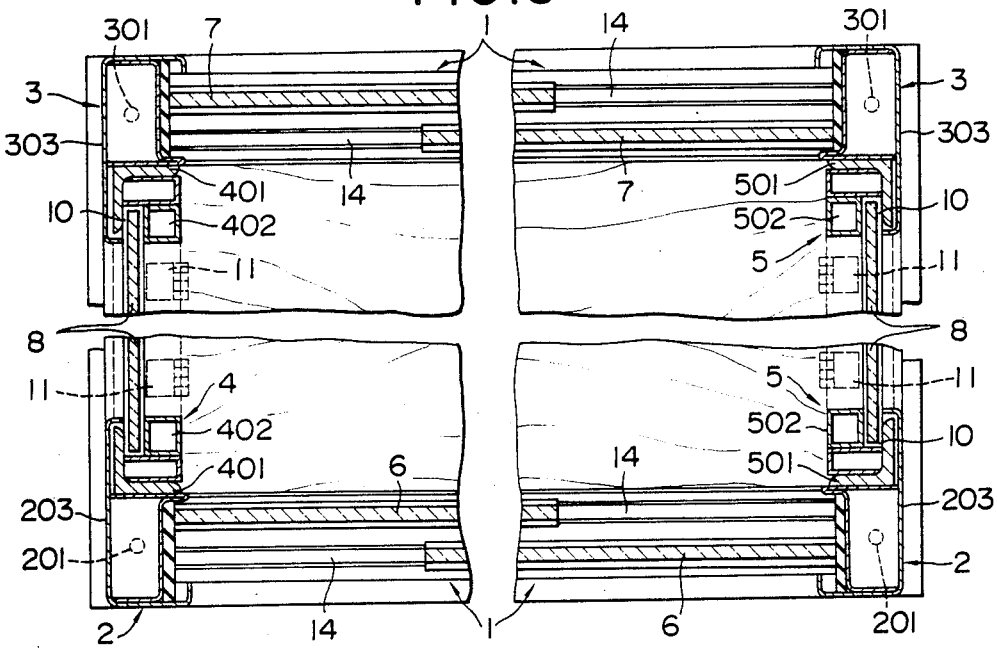
Figure 4:
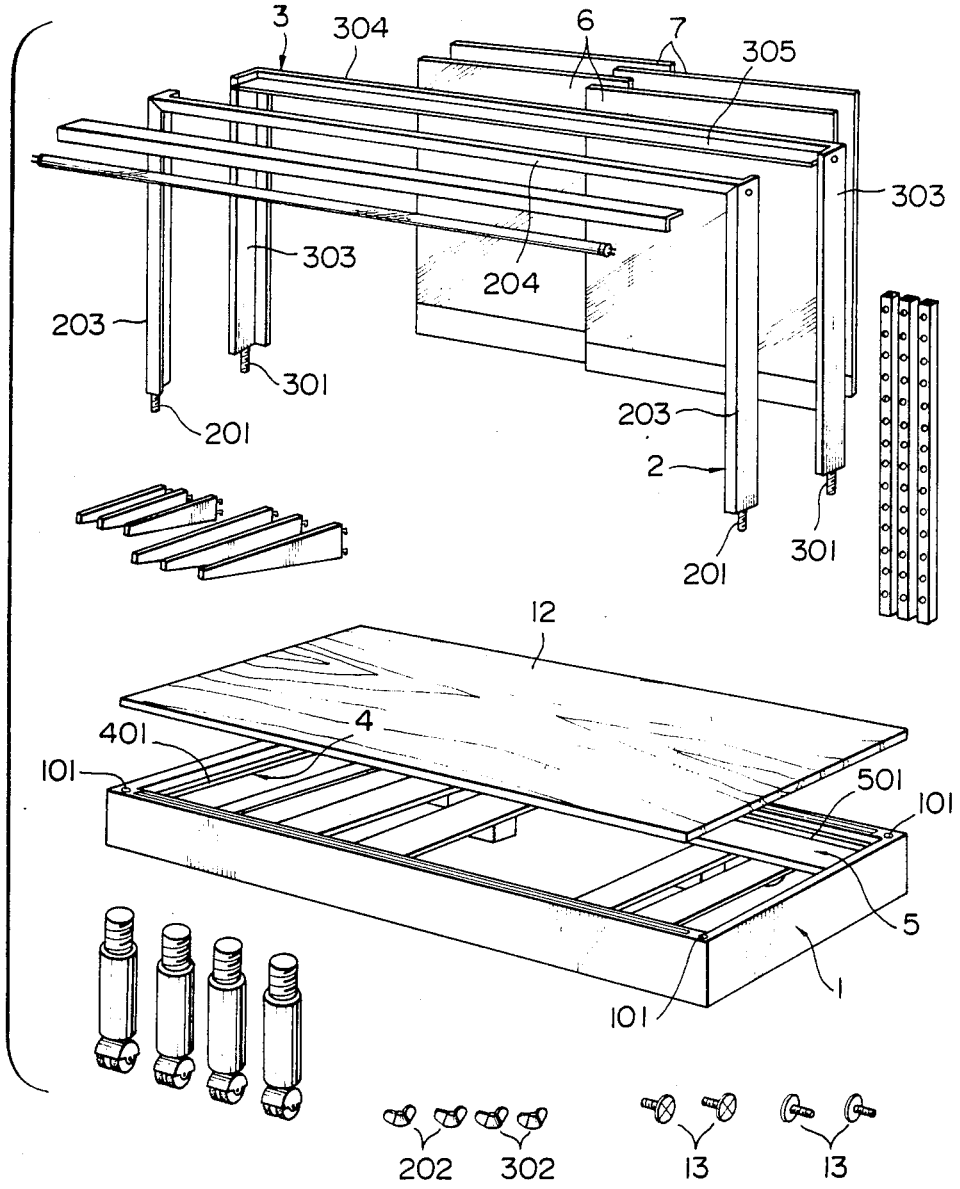
Figure 5:
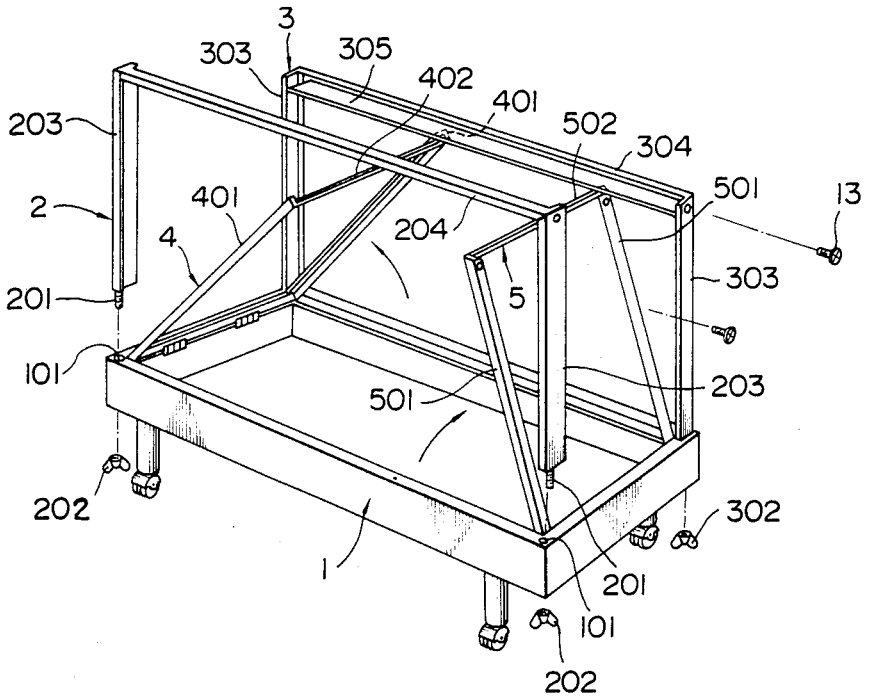
Figure 6:
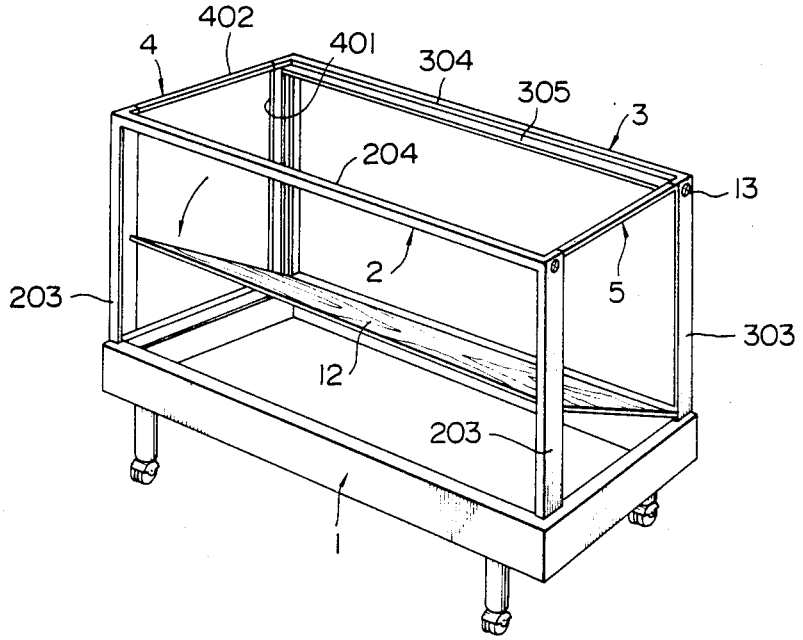
Figure 7:
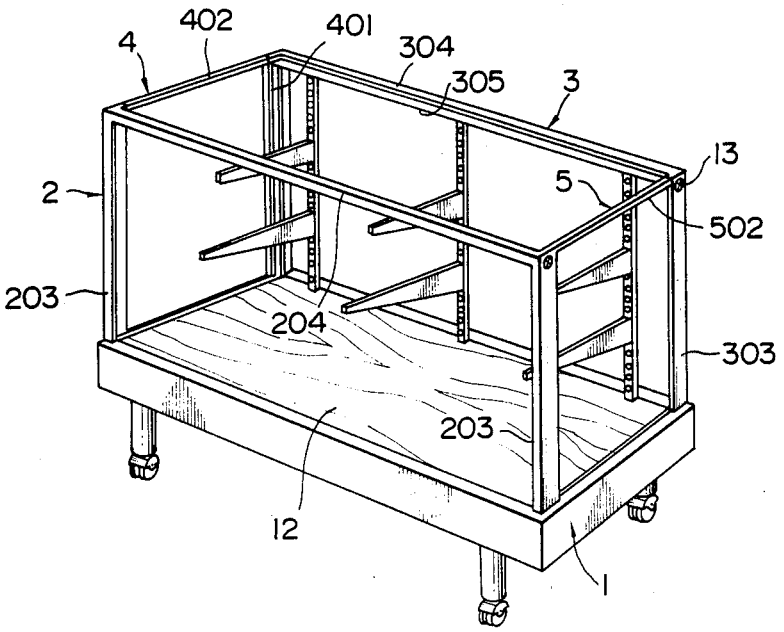
Figure 8:
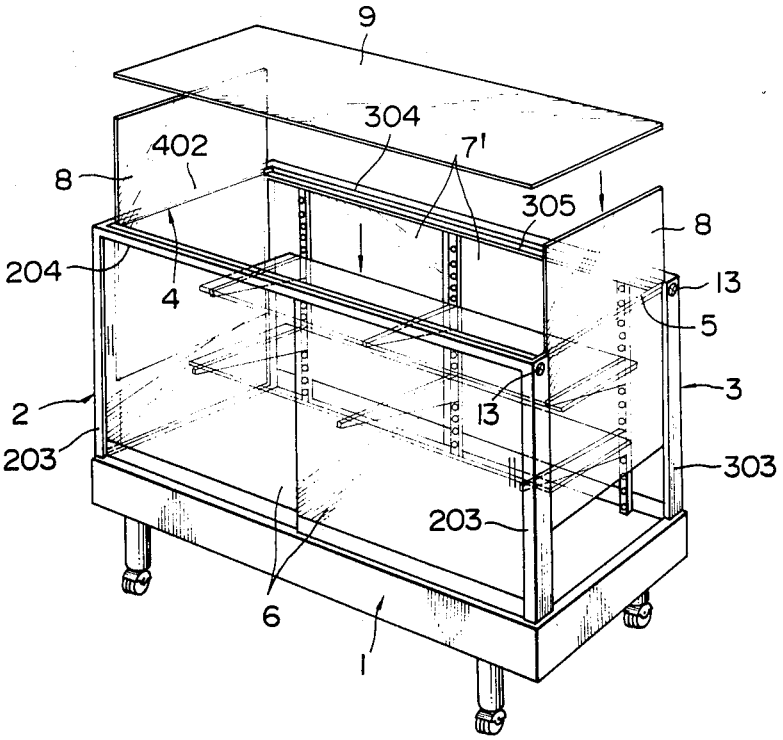

In the drawings,

FIG. 1 is a front view, partially in section, of one embodiment of a display case in accordance with the present invention, FIG. 2 is a longitudinal, sectional side view of the display case of FIG. 1, FIG. 3 is a cross-sectional plan view of the display case of FIG. 1, FIG. 4 is an exploded, perspective view of the display case, and FIGS. 5 to 8 respectively are perspective views showing the sequence for assembly of the display case, FIGS. 5 and 6 omitting the illustration of the bottom of the bed frame.

As is shown in the drawings, screws 201 and 301 respectively are projectingly provided on both end portions of gate-shaped front or inverted U-shaped frame 2 and both end portions of gate-shaped rear frame 3. Screws 201 and 301 extend through longitudinal througholes 101 bored in the four corners of bed frame 1 and are fastened by means of wing nuts 202 and 302. Thus, front frame 2 and rear frame 3 are in an upright or vertical position and are secured to the front side and the rear side, respectively, of bed frame 1 and are separable from the bed frame. Lower portions of both left and right side frames 4 and 5 of square in side are mounted by means of hinges internally of both left and right sides of bed frame 1. Side frames 4 and 5 respectively comprise inner pipes 402 and 502 of square cross-section having sides thereof in the form of a gate-shape ( -shape shown in FIG. 2) which are fixedly mounted internally of outer levers 401 and 501 having an L-shape cross-section and having sides in the form of a recess-shape (⊔-shape shown in FIG. 2). Inserting gaps 10, through which transparent glass plates 8 for both the left and right sides are inserted, are formed between outer levers 401 and 501 and inner pipes 402 and 502, the lower portions of the outer levers 401 and 501 being fixed to bed frame 1 by means of hinges 11. Left side frame 4 and right side frame 5, which are respectively formed into a square shape by outer levers 401 and 501 of the recess-shape inside and the inner pipes 402 and 502 of the gate-shape inside, are able to be in an upright position as well as to be laid down with respect to the interior of both left and right sides of bed frame 1 and are able to be laid down and housed between the front side and the rear side of the bed frame. The longitudinal sides of outer levers 401 and 501 of the left side frame 4 and the right side frame 5 are made so as to be upright internally of longitudinal frame levers 203 and 303 of front frame 2 and rear frame 3 respectively.

In front frame 2 and rear frame 3, mounting plates (not shown) for mounting screws may be provided on both ends of longitudinal frame levers 203 and 303 as necessary in order to obtain a stabilized mounting condition. In this case, instead of providing the mounting structure of said mounting plates, longitudinal frame levers 203 and 303 each are made to comprise a lever having a recess in section, a lever having a square in section or the like, bases of screws 201 and 301 are fixedly mounted on both ends thereof, and when the levers are in a vertical position while being screwed into bed frame 1, a contact area between the ends of longitudinal frame levers 203 and 303 and the upper surface of the bed frame becomes widened to obtain a stabilized mounting condition.

Both left and right side frames 4 and 5 are respectively composed of outer levers 401 and 501 of an L-shaped cross-section and inner pipes 402 and 502 of square section, the outer levers being in the form of a recess-shape (⊔-shape) and the inner pipes being in the form of a gate-shape ( -shape). Because a circumferential side portion of bottom plate 12 is placed on the horizontal upper surface at the lower portion of the outer levers 401 and 501, a stable upright position is obtained. Outer levers 401 and 501 are reinforced by inner pipes 402 and 502 to remove any instability resulting from the use of only the outer levers. Both the left and right side frames 4 and 5 are mounted by means of hinges internally of both left and right sides of bed frame 1, and the spacing between the front and rear longitudinal lever portions are set to be slightly narrower than a spacing between the longitudinal frame levers 203 and 303 of front and rear frames 2 and 3 so that when the side frames are upright, outer levers 401 and 501 are positioned internally of the longitudinal frame levers 203 and 303. The upper portions of the outer levers 401 and 501 are separably secured to upper portions of the longitudinal frame levers 203 and 303 by means of set screws 13 which unites the front and rear frames 2 and 3 and both the left and right side frames 4 and 5 so as to obtain a stabilized mounting condition. Hinges 11 used to mount both the left and right side frames 4 and 5 on bed frame 1 are disposed such that one hinge portion 1101 (upper side in FIG. 1) is fastened to the horizontal lower surface at the lower part of outer levers 401 and 501. Other hinge portion 1102 (lower side in FIG. 1) opposite to the former is fastened to the lower surface of edge 102 of bed frame 1 so that when both left and right side frames 4 and 5 are upright, edge 102 is held between the hinge portions 1101 and 1102, and both left and right side frames 4 and 5 may be laid down toward the interior of bed frame 1.

Sliding door 6 in the front surface and a sliding door in the rear surface are mounted between rails 14 installed on the front upper surface and rear upper surface of bed frame 1 and lintels 15 and 16 are provided on the lower surfaces of upper horizontal levers 204 and 304 of the front and rear frames 2 and 3 respectively and disposed so that the doors are capable of being opened and closed. Transparent glass plates 8 for both the left and right sides of the display case are inserted into and mounted in inserting gaps 10 of both left and right side frames 4 and 5. Transparent glass plate 9 is placed over the upper surface between support edges 205 and 305 inwardly projecting from upper horizontal levers 204 and 304 of the front and rear frames 2 and 3 and inner pipes 402 and 502 of both left and right side frames 4 and 5. In placing transparent glass plate 9 on the upper surface, buffer elements (not shown) such as felt are precoated on support edges 205 and 305 and on inner pipes 402 and 502. It is noted that both the sliding doors 6 and 7 are oftentimes transparent, however, sliding door 7 in the rear surface may be opaque.

Since, in the present invention, the front and rear frames and the bed frame are separable and both the left and right side frames are mounted on the bed frame by means of hinges such that they can be laid down into the bed frame as described above, the invention has an effect in that, if the front and rear frames are separated from the bed frame and both the left and right side frames are laid down into the bed frame, the display case can be transported and stored in a compact condition. After the display case has been assembled, both the left and right side frames are erected internally of the front and rear frames, and therefore, there is no fear of damaging the external appearance. In addition, when upright, both the left and right side frames are separably secured to the front and rear frames, and therefore, these side frames and front and rear frames may be unified to reduce possible instability and thereby reduce possible damage to the sliding doors and the transparent glass plates. Accordingly, the intended objects of the invention are achieved.

What is claimed:

1. A display case comprising an inverted U-shaped front frame and an inverted U-shaped rear frame, both ends of each frame being separably mounted on four corners of a bed frame; a left and a right square side frame, the lower portions of both side frames being mounted by hinges interiorly of both left and right sides of the bed frame, said both left and right side frames being able to be laid down and housed within the bed frame and able to be erected internally of the front frame and the rear frame, said both erected left and right side frames being separably secured to the front frame and to the rear frame; transparent sliding doors in the front frame and in the rear frame; and transparent glass plates in both left and right square side frames and on the upper surface of the display case.

2. A display case according to claim 1, wherein each said frame comprises an inner member having sides thereof in the form of a U-shape, the member fixedly mounted internally of an outer lever having sides in the form of a recess-shape.

3. A display case according to claim 3, wherein the inner members are of a square cross-section.

4. A display case according to claim 2, wherein the outer levers are of an L-shape cross-section.

* * * * *